US007100413B2

(12) United States Patent
Derichs

(10) Patent No.: US 7,100,413 B2
(45) Date of Patent: Sep. 5, 2006

(54) DEEP-ROLLING ROLLER HEAD

(75) Inventor: Heinrich Wilhelm Derichs, Wegberg (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 0 days.

(21) Appl. No.: 10/505,184

(22) PCT Filed: May 2, 2003

(86) PCT No.: PCT/EP03/04589

§ 371 (c)(1),
(2), (4) Date: Aug. 18, 2004

(87) PCT Pub. No.: WO2004/004972

PCT Pub. Date: Jan. 15, 2004

(65) Prior Publication Data

US 2005/0086988 A1 Apr. 28, 2005

(30) Foreign Application Priority Data

Jul. 5, 2002 (DE) ..... 102 30 526

(51) Int. Cl.
*B21D 15/00* (2006.01)
*B21K 1/08* (2006.01)

(52) U.S. Cl. ..... 72/110; 29/6.01

(58) Field of Classification Search ..... 72/107, 72/110; 29/6.01
See application file for complete search history.

(56) References Cited

U.S. PATENT DOCUMENTS 5,445,003 A 8/1995 Gottschalk et al.
5,495,738 A 3/1996 Gottschalk
5,575,167 A 11/1996 Gottschalk et al.
5,699,692 A 12/1997 Lonero et al.
5,806,184 A 9/1998 Lonero et al.
6,257,037 B1 * 7/2001 Lonero et al. ..... 72/110
6,601,424 B1 8/2003 Bagusche

FOREIGN PATENT DOCUMENTS

DE 26 09-787 9/1977

(Continued)

*Primary Examiner*—Ed Tolan
(74) *Attorney, Agent, or Firm*—Proskauer Rose LLP

(57) ABSTRACT

The invention relates to a deep-rolling roller head (1) of a deep rolling tool with deep-rolling rollers (2) that are rotatably mounted in roller cages (3) and are at a distance (4) from the center (5) of the underside (6) of the housing (7) of the deep-rolling roller head (1) and are supported on the front (8) at the end of the long leg (9) of two L-shaped holding devices (11) that can be adjusted and fixed in the direction of the center (5). A first screw (13) enters an oblong hole (12) in each long leg (9) to hold the L-shaped holding device (11) on the underside of the housing (7) while a second screw (14) passes through a bore (15) in each short leg (10 and enters a bore (26) in the adjoining front (21) of the housing (7), being provided in order to adjust the precise position of the roller cage (3) relative to the center (5). With the L-shaped holding device (11) shown on the left half of the drawing the front (25) adjoining the underside (6) is at a predetermined first distance (18) from the center (5) over a segment (17) of its length. The appertaining short leg (10) is supported over a segment of its inside on the segment (17) of the housing (7). The front (8) of the appertaining long leg (9) is at a predetermined distance (17) from the segment (17).

2 Claims, 2 Drawing Sheets

FOREIGN PATENT DOCUMENTS

| | | |
|---|---|---|
| DE | 100 40 146 | 3/2002 |
| EP | 0 661 137 | 7/1995 |
| EP | 0 683 012 | 11/1995 |
| EP | 0 839 607 | 5/1998 |

* cited by examiner

DEEP-ROLLING ROLLER HEAD

RELATED APPLICATIONS

This application was filed in accordance with 35 U.S.C. §371 and is the U.S. National stage of International Application No. PCT/EP03/004589, filed on May 2, 2003. This application claims priority under 35 U.S.C. §119(a) or 35 U.S.C. §365(b) to German application number 102 30 526.9-14, filed on Jul. 5, 2002. The disclosures of the above-referenced applications are hereby incorporated by reference in their entirety.

The present invention relates to a deep-rolling roller head of a deep-rolling tool for the deep rolling of radii or undercuts at the bearing journals of crankshafts by means of deep-rolling rollers that move freely rotatably in roller cages, supported at a distance from each other closely to the center of the underside of the prismatic housing of the deep-rolling roller head towards the crankshaft on the face at the end of the long legs of two L-shaped holding devices, each of which having a long and a short leg, said holding devices being adjustable and fixable in the direction of the center of the underside, in that the long leg is provided with an oblong hole into which a first screw is engaged by which the corresponding L-shaped holding device is held on the underside of the housing, while a second screw passes through a bore in the short leg and with its outer end enters a bore in the face of the housing adjoining the underside, whereby the second screw serves to set the precise position of the roller cage relative to the center of the underside.

BACKGROUND OF THE INVENTION

Deep-rolling roller heads of the type mentioned above have become known from a comprehensive state of the art. The following printed publications are listed here in this respect:

1. EP 0 661 137 B1, FIG. 6, col. 9, lines 22 to 25,
2. EP 0 683 012 B1, FIG. 4, col. 5, lines 51 to 56,
3. EP 0 839 607 A1, FIG. 1, col. 3, lines 34 to 36,
4. U.S. Pat. No. 5,575,167, FIG. 7, col. 5, lines 30 to 32,
5. U.S. Pat. No. 5,806,184, FIG. 2*a*, col. 2, lines 58 to 60,
6. DE 100 40 146 A1, FIG. 5, col. 2, line 59 to col. 3, line 14.

Without exception, all the known deep-rolling roller heads have in common that precise adjustment of the deep-rolling rollers relative to the center of the deep-rolling roller head is extremely difficult and requires great skill on the part of the adjusting person schooled in the art. In this case precise adjustment to the center of the deep-rolling roller head is not even desired, but a pre-adjustment in the order of magnitude between 0.1 and 0.2 is effected in the sense opposite to the sense of rotation of the crankshaft. For precise adjustment of the deep-rolling roller devices have therefore been developed that facilitate the adjustment on the part of the person schooled in the art while achieving at the same time an adjusting result of sufficient precision. This becomes understandable when the L-shaped holding devices of the roller cages known from the state of the art must be adjusted and fixed by two screws at each deep-rolling roller head. Overall therefore, four screws per deep-rolling roller head are used by means of which the L-shaped holding devices are fixed, and their precise adjustment is difficult and time consuming.

Therefore there has been no lack of effort in facilitating the adjustment of the L-shaped holding devices and to improve at the same time the precision of adjustment.

In the state of the art known from DE 100 40 146 A1 different embodiments of an L-shaped holding device are already mentioned. While the one holding device still follows the classic design with long leg, oblong hole, first adjustment and fixing screw, short leg, bore, second adjustment and fixing screw, bore, second adjustment and fixing screw, the second L-shaped holding device across from it already lacks the oblong hole and the first adjustment and fixing screw in the long leg. Only the second L-shaped holding device is attached to the housing of the deep-rolling roller head through the short leg and a second screw that is however not adjustable. Mostly pin-shaped bodies are provided for a point-shaped support of the deep-rolling rollers and move within the long leg and along it in an adjustable and fixable manner. The adjustability of the holding device along the long leg was thus reduced to the adjustability of the roller support.

Another solution provided by the present invention consists in simplifying the deep-rolling roller head in a suitable manner so that a fixed stop is created for one of the two roller cages before the second roller cage is adjusted relative to it and is fixed by the appertaining L-shaped holding device as the deep-rolling roller head is inserted. Together with this, the deep-rolling roller head is to be simplified at the same time and the adjustment of the deep-rolling rollers is to be feasible with greater precision and at no additional cost.

SUMMARY OF THE INVENTION

According to the invention this object is attained in that one of the two faces of the housing adjoining the underside is at a predetermined first distance from the center of the underside, at least over a segment of its length, the short leg of the corresponding L-shaped holding device is supported over at least a segment of its inside towards the housing on the segment of the housing that is at a first distance from the center of the underside, while the face of the long leg of this holding device which supports the roller cage is at a predetermined second distance from the segment of the housing on which the short leg is supported.

In the present case this means that only a first one of the two L-shaped holding devices can be adjusted and fixed relative to the housing of the deep-rolling roller head. The other, second L-shaped holding device is brought into contact by its short leg with the surfaces of the housing which are at a predetermined first fixed distance from the center of the housing. However this also results at the same time in that the face of this second L-shaped holding device is also at a fixed, i.e. second distance from the contact surface of the housing, whereby a corresponding dimensional accuracy of the adjoining roller cage is a necessary condition for the precise positioning of the deep-rolling rollers. The roller cage then comes to bear on this face. The second holding device is attached by means of two screws to the deep=rolling roller head in a known manner, one of these screws reaching through the oblong hole in the long leg of the holding device and into the housing of the deep-rolling roller head. The second roller cage is pushed up against the fixed stop that has thus been created by means of the first L-shaped holding device while the two deep-rolling rollers are inserted and this first L-shaped holder is attached to the housing by one screw in the long and one screw in the short leg, as is already known from the state of the art.

The special advantage of this simplification of the deep-rolling roller head consists in the fact that deep-rolling roller heads that have already been used can be retrofitted according to the invention. Independently of this however, sufficiently great precision can very easily be achieved for the adjustment of the deep-rolling rollers so that also less qualified operating personnel can be entrusted with the adjusting task.

One of the two faces adjoining the underside of the housing of the deep-rolling roller constitutes the front. In connection with this arrangement, the second face away from the front of the housing is preferably provided with a fixed stop for the second L-shaped holding device.

To transmit the forces exerted by the deep-rolling rollers via the roller cages upon the deep-rolling roller head, every second screw is inserted into a corresponding threaded bore of the housing of the deep-rolling roller head and is screwed in there.

The invention is described in further detail below through an example of an embodiment.

BRIEF DESCRIPTION OF THE DRAWINGS

Drawn to approximate scale.

DETAILED DESCRIPTION OF THE INVENTION

Figure 2:
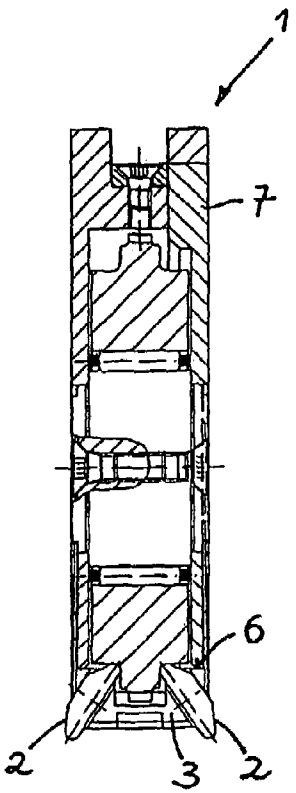
FIG. 2 shows a segment through the deep-rolling roller head of FIG. 1 along line II—II and FIG. 3, 4 and 5 show a second L-shaped holding device in the three usual views.

The deep-rolling roller head 1 of a deep rolling tool (not shown) for the deep rolling of radii or undercuts on the bearing journals of crankshafts (not shown) operates by means of deep-rolling rollers 2 guided freely in roller cages 3. The guiding of the deep-rolling rollers 2 in the roller cages 3 takes place with clearance, whereby the guiding surfaces of the roller cages 3 support the deep-rolling rollers 2 on two sections of their circumference across from each other. The clearance between the deep-rolling rollers 2 and the roller cages 3 is from 0.1 and 0.5, preferably 0.2 mm.

Figure 1:
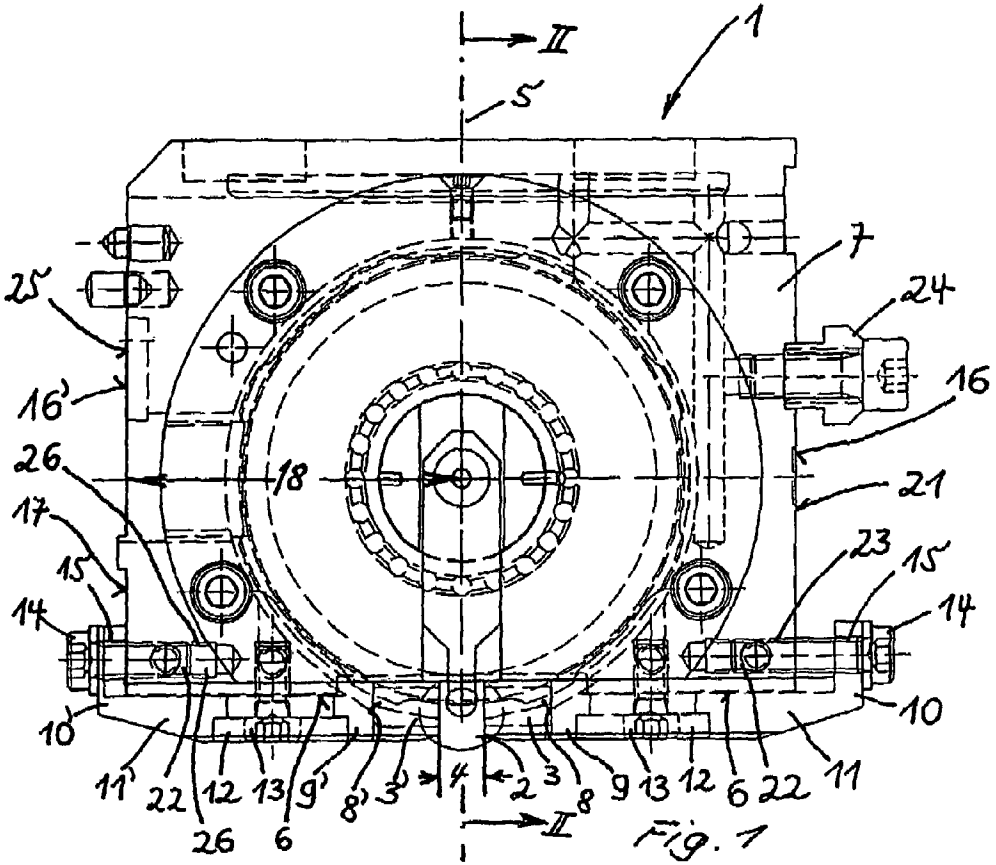
FIG. 1 shows a deep-rolling roller head in a side view.
Figure 4:
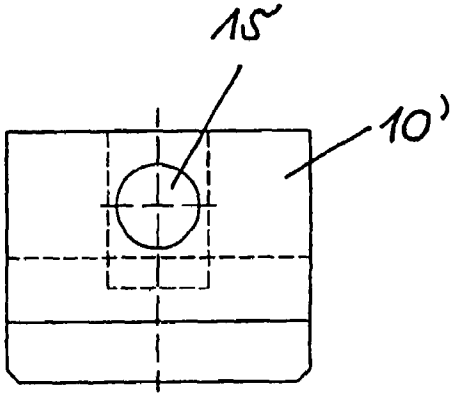

As can be seen in FIG. 1, the two roller cages 3 are at a distance 4 from each other. The roller cages 3 are often located nearly in the center 5 of the underside 6 of the prismatic housing 7 towards the crankshaft of the deep-rolling roller head 1. The roller cages 3 are supported on the fronts 8 of the long legs 9 of two L-shaped holding devices 11. Each of the two L-shaped holding devices 11 has a long leg 9 and a short leg 10. The L-shaped holding devices 11 can be attached to the underside 6 of the housing 7. For this purpose the long leg 9 of each of the two L-shaped holding devices 11 is provided with an oblong hole 12 in which a first screw 13 by which the respective L-shaped holding device 11 is held on the underside 6 of the housing 7 of the deep-rolling roller head 1 is engaged. A second screw 14 passes through a bore 15 in the short leg 10 of the L-shaped holding device 11 and with its extreme end 22 into a threaded bore 23 or 26 on the underside 6 of the adjoining face 16 of the housing 7. Here the second screw 14 is designed to reliably transfer the forces applied by the deep-rolling rollers 2 via the roller cages 3 on the deep-rolling roller head 1.

Figure 3:
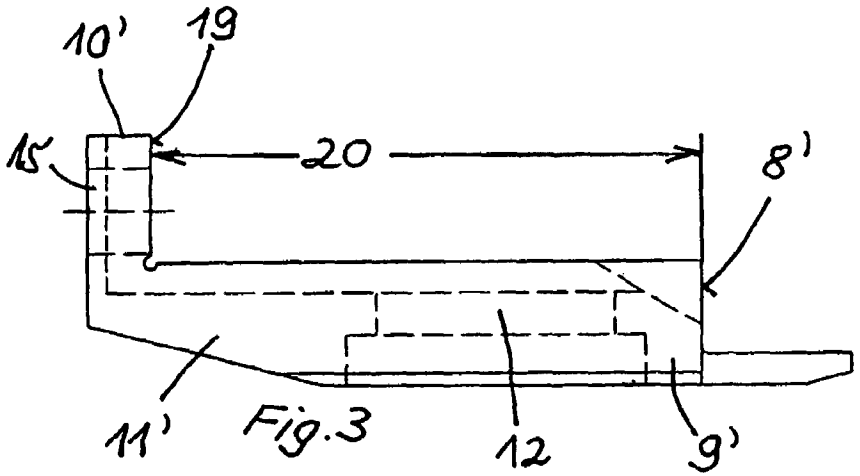
Figure 5:
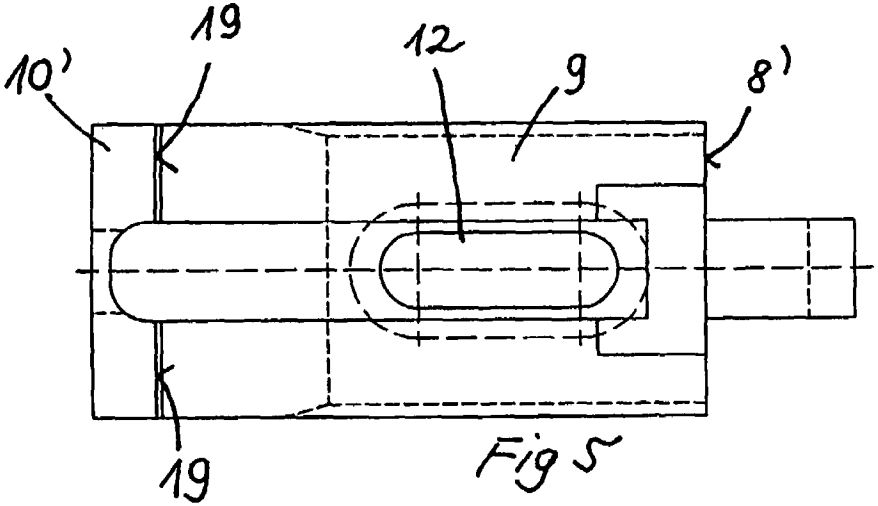

With the second L-shaped holding device 11' shown on the left half of FIG. 1, the second screw 14 passes through the bore 15 in the short leg 10 into the bore 26 in the face 16' of the deep-rolling roller head 1. A segment 17 of the face 16' of the housing 7 adjoining the underside 6 is at a fixed distance 18 from the center 5 of the housing 7. The short leg 10' of the second L-shaped holding device 11' is supported by its inside 19 on the segment 17 (FIG. 3). To ensure that the adjoining roller cage 3' is also located in a precisely defined position relative to the center 5 of the housing 7, the front 8' of the long leg 9' is also at a second predetermined distance 20 from the segment 17.

Only the first L-shaped holding device 11 shown on the right half of FIG. 1 is yet to be adjusted and fixed in a known manner relative to the housing 7. Here the second screw 14 serves to pass through a bore 15 in the short leg 10 and to enter with its forward end 22 into a threaded bore 23 of the housing 7. The first L-shaped holding device 11 shown on the right half of FIG. 1 is adjusted and fixed in a known manner to the housing 7 by means of the two screws 13 and 14. The clearance between the deep-rolling rollers 2 and the roller cages 3 holding the deep-rolling rollers 2 can be adjusted more precisely there by means of the second screw 14; it measures from 0.1 to 0.5 mm, preferably 0.2 mm. There is also a predetermined deviation from center of the deep-rolling rollers 2 relative to the center 5 of the housing 7 which, as is customary, also measures from 0.1 to 0.5, preferably 0.2 mm. in opposite direction of that of the crankshaft.

A journal 24 on the front 21 of the housing 7 serves to apply a tool (not shown) to handle the deep-rolling roller head 1. The segment 17 which is at a first fixed distance 18 from the center 5 of the housing 7 is provided on the opposite face 25.

LIST OF REFERENCE NUMBERS

1 deep-rolling roller head
2 deep-rolling rollers
3 roller cages
4 distance
5 center
6 underside
7 prismatic housing
8 front
9 long leg
10 short leg
11 L-shaped holding device
12 oblong hole
13 first screw
14 second screw
15 bore
16 adjoining face
17 segment
18 first distance
19 inside
20 second distance
21 front
22 end of the second screw
23 threaded bore
24 journals
25 second front
26 bore

The invention claimed is:

1. Deep-rolling roller head of a deep-rolling tool for the deep rolling of radii or undercuts on the bearing journals of crankshafts by means of deep-rolling rollers that are freely rotatable in roller cages, that are supported at a distance from each other nearly in the center of an underside of a prismatic housing of the deep-rolling roller head towards the crankshaft, each on a front of a long leg of two L-shaped holding devices each possessing one long and one short leg, whereby a holding device can be adjusted and fixed in a direction of the center of the underside in that the long leg is provided with an oblong hole into which a first screw is inserted and by which the L-shaped holding device concerned is held on the underside of the housing while a second screw passes through a bore in the short leg and enters with its outer end into a bore at the face of the housing adjoining the underside, whereby the second screw is provided to adjust the precise position of the roller cage in relation to the center of the underside, wherein one of two faces of the housing adjoining the underside is at a predetermined first distance from the center of the underside over at least a segment of its length, the short leg of one of the two L-shaped holding devices is supported over at least a portion of its inside towards the housing on the segment of the housing that is at a first distance from the center of the underside, while the front of the long leg of this holding device supporting an adjoining roller cage is at a predetermined second distance from the segment of the housing on which the short leg is supported.

2. Deep-rolling roller head as in claim 1, where one of two faces adjoining the underside of the housing constitutes a front of the deep-rolling roller head, while the second face of the housing away from the front is at the first distance from the center of the underside.

* * * * *